US005511255A

United States Patent [19]

Schuerch

[11] Patent Number: 5,511,255

[45] Date of Patent: Apr. 30, 1996

[54] MEDICAL PATIENT SHIFTING DEVICE AND METHOD OF USE

[76] Inventor: Peter Schuerch, 42 Bayview Ave., Quincy, Mass. 02169

[21] Appl. No.: 377,393

[22] Filed: Jan. 24, 1995

[51] Int. Cl.[6] ..... A61G 12/00

[52] U.S. Cl. ..... 5/81.1; 5/922; 5/925

[58] Field of Search ..... 5/81.1, 417–420, 5/625, 627, 925, 926, 922

[56] References Cited

U.S. PATENT DOCUMENTS

| | | | |
|---|---|---|---|
| D. 322,532 | 12/1991 | Kumar et al. | D6/596 |
| 2,528,048 | 10/1950 | Gilleland | 5/86.1 |
| 3,268,922 | 8/1966 | Moxley | 5/420 |
| 3,329,978 | 7/1967 | Porter et al. | 5/81.1 |
| 3,829,914 | 10/1974 | Treat | 5/625 |
| 3,849,813 | 11/1974 | Neilson | 5/81.1 |
| 4,012,799 | 3/1977 | Rutherford | 5/81.1 |
| 4,067,079 | 1/1978 | Buchman | 5/81.1 |

*Primary Examiner*—Alexander Grosz
*Attorney, Agent, or Firm*—John M. Brandt

[57] ABSTRACT

A medical patient shifting device consisting of a thin flexible rollable platform adapted to be placed under a drawsheet on a patient support to facilitate moving the patient by sliding over the platform to a second adjacent support.

4 Claims, 1 Drawing Sheet

MEDICAL PATIENT SHIFTING DEVICE AND METHOD OF USE

BACKGROUND OF THE INVENTION

1. Field of the Invention

The invention resides in the field of apparatus for transporting medical patients and more particularly relates to a device for slideably shifting a patient from one patient support to another.

2. Description of the Prior Art

A number of devices designed to facilitate slideably shifting a patient from one support to another are fouled in the prior art. The purpose of these is to avoid lifting or rolling the patient from, for example, a wheeled stretcher to a permanent hospital bed. In particular U.S. Pat. No. 2,528,048, Gilleland, discloses a hinged transfer leaf attached to the side of a stretcher. Similarly, U.S. Pat. No. 3,329,978, Porter, shows a rigid manually applicable bridging panel and U.S. Pat. No. 3,962,736, Fedele, illustrates a track and roller device for moving a patient in a bed.

Semi-flexible or bendable boards or slabs are described in U.S. Pat. Nos. 4,012,799, Rutherfold and 4,067,079, Buchman. The Buchman device is of sufficient thickness to support the weight of a patient and the patient remains atop the slab during the transfer. The Rutherfold apparatus while bendable is not sufficiently flexible to be rolled up for storage. Particular materials suggested for manufacture include stainless steel, fiber glass, MASONITE, or plastic.

The present invention provides an improvement in the above described devices which facilitates the use of such implements in the hospital and patient transfer environments to the increased benefit of the patients residing therein.

SUMMARY OF THE INVENTION

The invention may be summarized as an improved patient shifting device comprising a thin flexible rollable platform which fits under both a drawsheet and patient and which provides a surface upon which the patient may be slid from one support to another.

There are a number of benefits provided by this device when compared to the prior art. In particular, it has been found that as the platform is sufficiently thin to conform to the patient's body, the patient's comfort is enhanced and the patient may be shifted or transferred in any position, sitting up or lying down. Further, as it is completely rollable, it is easily stored and transported on the mobile stretchers where it is most likely to be used and as it is substantially cheaper to manufacture, may be purchased and distributed within the hospital in much greater quantities than the semi-flexible devices of the prior art.

Additionally, it is compact when rolled and lightweight providing an additional advantage over the bulkier, heavier items previously marketed.

These and other features and advantages of the Invention will be more fully understood from the description of the preferred embodiment and drawings which follow.

DESCRIPTION OF THE PREFERRED EMBODIMENT

Figure 1:
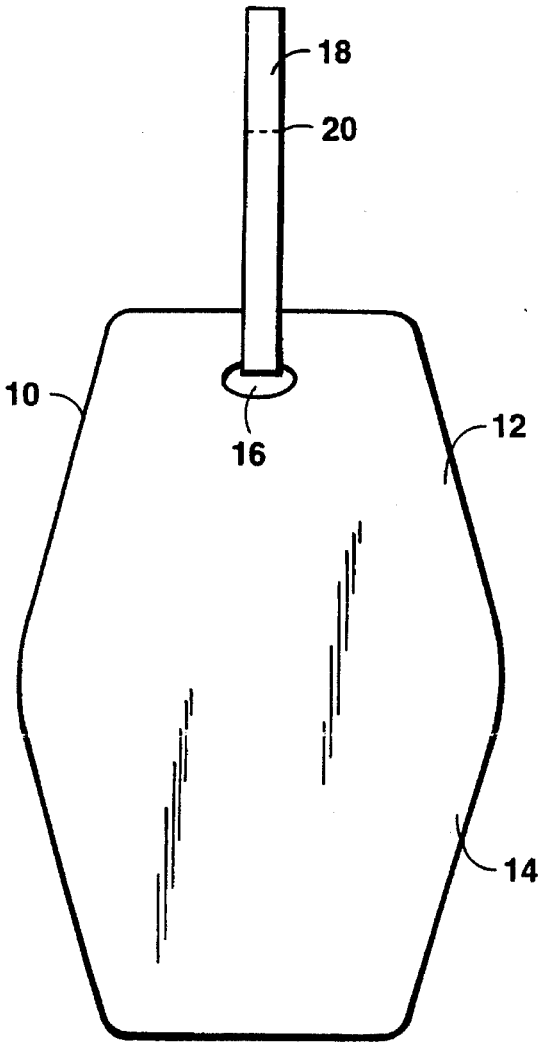
FIG. 1 is a plan view of the preferred embodiment of the invention.

Referring to FIG. 1, there is illustrated a plan view of the preferred embodiment of the invention comprising a thin, rollable, flexible platform 10 shaped as a pair of opposing polygons 12 and 14.

Figure 2:
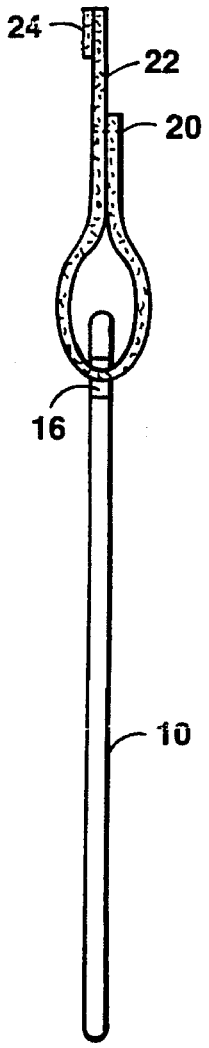
FIG. 2 is a side view of the device of FIG. 1.
Figure 3:
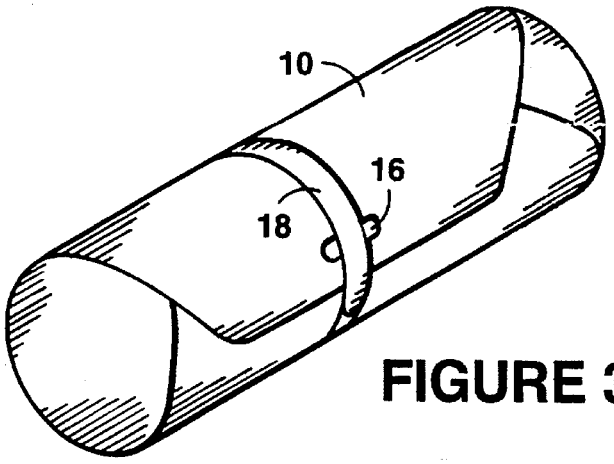
FIG. 3 is a perspective view of the invention in rolled up configuration.

Platform 10 has port 16 for receiving strap 18 used to secure the invention in a rolled up state for storage as illustrated in FIG. 3. The strap is secured to itself at seam 20 and as shown in FIG. 2 is composed of a separable fastener, surface 22 forming one half the mating pair and attached tab 24 the other. The separable fastener may be a hook and loop type fastener, such as the one sold under the Trademark of Velcro.

The invention is necessarily composed of a durable highly flexible smooth surfaced material. High density polyethylene sheet approximately one thirty second inch thick has been found to be a completely suitable material.

The use of the invention is similar to that described in the prior art discussed above. However, in that the platform differs from previously disclosed devices in its flexibility, the steps taken to shaft a patient are modified to incorporate the lifting up of the drawsheet. In the process the patient is slightly rotated to one side allowing the platform to be placed in the optimum position for effecting transfer without forcing an uncomfortably thick slab or sled under the drawsheet and patient's underside.

The steps taken fin the practice of the invention are therefore as follows. First, bring together and hold in place the two patient supports. Second, lift the drawsheet on which the patient is resting, rotating the patient slightly so that the platform may be placed substantially under the drawsheet and patient. Next slide the patient to the unoccupied support by pulling the drawsheet. Finally, remove the platform from beneath the patient by pulling toward the previously occupied support. This does not require lifting of the drawsheet due to the smoothness of the platform.

As certain modifications may now be made to the above described embodiment by those skilled in the art, the scope of the invention is hereby defined by the following claims.

What is claimed is:

1. A patient shifting device comprising a thin flexible rollable platform adapted to be placed under a drawsheet and patient on a first patient support to facilitate moving said patient by sliding over said platform to a second adjacent support, said platform including a port disposed at one end thereof and further including a two sided strap attached to said platform through said port, each of said strap sides having one of an opposing pair of separable fastener members, whereby said platform may be secured in a storable rolled condition by the engagement of said strap around said platform.

2. The apparatus of claim 1 wherein said platform is comprised of high density polyethelene sheet approximately one thirty second inch thick.

3. The method of shifting a medical patient atop a drawsheet from a first support to a second support comprising in combination the steps of 1. providing a thin flexible rollable platform, said platform including a port disposed at one end thereof and further including a two sided strap attached to said platform through said port, each of said strap sides having one of an opposing pair of separable fastener members, whereby said platform may be secured in a storable rolled condition by the engagement of said strap around said platform;

2. lifting said drawsheet and partially rotating said patient;

3. placing said platform under said drawsheet from the second support side; and 4. sliding said drawsheet and said patient across said platform from said first support to said second support.

4. The method of claim 3 further including the step of removing said platform from the first support side, rolling said platform and securing it in its rolled position.

* * * * *